US009808063B2

(12) United States Patent
Wang et al.

(10) Patent No.: US 9,808,063 B2
(45) Date of Patent: Nov. 7, 2017

(54) HEAT CONDUCTING MECHANISM FOR PERSONAL CARE DEVICE AND PERSONAL CARE DEVICE

(71) Applicant: ZHEJIANG PAITER ELECTRIC CO., LTD., Wenzhou, Zhejiang (CN)

(72) Inventors: Rentong Wang, Zhejiang (CN); Zhiyong Yu, Zhejiang (CN)

(73) Assignee: ZHEJIANG PAITER ELECTRIC CO., LTD., Wenzhou, Zhejiang (CN)

( * ) Notice: Subject to any disclaimer, the term of this patent is extended or adjusted under 35 U.S.C. 154(b) by 66 days.

(21) Appl. No.: 14/901,686

(22) PCT Filed: Aug. 13, 2014

(86) PCT No.: PCT/CN2014/084258

§ 371 (c)(1),
(2) Date: Dec. 28, 2015

(87) PCT Pub. No.: WO2015/000449

PCT Pub. Date: Jan. 8, 2015

(65) Prior Publication Data

US 2016/0367001 A1 Dec. 22, 2016

(30) Foreign Application Priority Data

Jul. 1, 2013 (CN) ..... 2013 1 0271401
Aug. 30, 2013 (CN) ..... 2013 1 0385528

(51) Int. Cl.
*A45D 2/40* (2006.01)
*A45D 2/00* (2006.01)
(Continued)

(52) U.S. Cl.
CPC ..... *A45D 2/001* (2013.01); *A45D 1/04* (2013.01); *A45D 6/00* (2013.01)

(58) Field of Classification Search
CPC ... A45D 1/00; A45D 1/04; A45D 1/06; A45D 1/08; A45D 1/12; A45D 1/14; A45D 1/16;
(Continued)

(56) References Cited

U.S. PATENT DOCUMENTS

2006/0102191 A1* 5/2006 Nakamura ..... A45D 2/36 132/229
2008/0127989 A1* 6/2008 Chapman ..... A45D 24/10 132/118
2011/0162672 A1 7/2011 Liebenthal et al.

FOREIGN PATENT DOCUMENTS

CN 102811642 A 12/2012
CN 203 041 070 U 7/2013

* cited by examiner

*Primary Examiner* — Rachel Steitz
(74) *Attorney, Agent, or Firm* — Christensen, Fonder, Dardi & Herbert PLLC

(57) ABSTRACT

A heat conducting mechanism for a personal care device comprising: a heat conductor and a mounting rack, wherein, the heat conductor is fixedly mounted on the mounting rack. The heat conductor is an aluminum plate, and a bamboo fiber layer or a carbon fiber layer is arranged at a working face of the heat conductor. According to the disclosure, the aluminum plate and bamboo fibers are combined, and the aluminum plate is easy to form, low in machining requirements and low in material cost. For example, for a using face, the bamboo fibers are additionally arranged at a surface of the aluminum plate. The bamboo fibers have good breathability and high wear resistance, and have the functions of natural antibiosis, bacteriostasis, mite removal, deodorizing and ultraviolet ray resistance, and thus the effect of environmental protection is achieved.

9 Claims, 2 Drawing Sheets

(51) Int. Cl.
*A45D 1/04* (2006.01)
*A45D 6/00* (2006.01)

(58) Field of Classification Search
CPC ... A45D 1/18; A45D 1/20; A45D 1/28; A45D 2/00; A45D 2/001; A45D 2/002; A45D 2/362; A45D 2001/00; A45D 6/00
See application file for complete search history.

HEAT CONDUCTING MECHANISM FOR PERSONAL CARE DEVICE AND PERSONAL CARE DEVICE

RELATED APPLICATIONS

The present application is a National Phase entry of PCT Application No. PCT/CN2014/084258, filed Aug. 13, 2014, which claims priority to Chinese Patent Application No. 201310271401.6, filed Jul. 1, 2013, and Chinese Patent Application No. 201310385528.0, filed Aug. 30, 2013, the disclosures of which are hereby incorporated by reference herein in their entirety.

FIELD OF THE INVENTION

The disclosure relates to cosmetology and hairdressing appliances, and particularly to a heat conducting mechanism for a personal care device and a personal care device.

BACKGROUND

For an existing personal care device, mostly, its heating plate is directly made of an aluminum plate. However, the aluminum plate is lower in strength, is easy to wear, and is not high in heat resistance.

SUMMARY

To solve the defects in the background, an object of the disclosure is to provide a heat conducting mechanism for a personal care device and a personal care device using the heat conducting mechanism.

The technical solutions used by the disclosure to solve the technical problem thereof are as follows.

A heat conducting mechanism for a personal care device includes: a heat conductor and a mounting rack, wherein, the heat conductor is fixedly mounted on the mounting rack, the heat conductor is an aluminum plate, and a bamboo fiber layer or a carbon fiber layer is arranged at a working face of the heat conductor.

Preferably, the bamboo fiber layer or the carbon fiber layer and the heat conductor are independent respectively, and the bamboo fiber layer or the carbon fiber layer is matched with the heat conductor in an insertion way.

Preferably, cone-shaped grooves are formed at the surface of the heat conductor, two sides of the bamboo fiber layer or the carbon fiber layer are fitted with the cone-shaped grooves, and the bamboo fiber layer or the carbon fiber layer is inserted into the cone-shaped grooves.

Preferably, convex clamping blocks are arranged on inner topper sides of a groove of the mounting rack, and concave grooves fitted with the clamping blocks are arranged at the outer surface of the heat conductor.

Preferably, a surface of the bamboo fiber layer or the carbon fiber layer is higher than the surface of the heat conductor.

A personal care device using the heat conducting mechanism includes: a pair of holding components, tails of which are hinged, wherein, the heat conducting mechanism is arranged inside the holding components, a heating body is embedded in the heat conducting mechanism, and the heat conducting mechanism is in contact with the heating body.

The beneficial effects of the disclosure are as follows. The aluminum plate and bamboo fibers are combined, and the aluminum plate is easy to form, low in machining requirements and low in material cost. For example, for a using face, the bamboo fibers are additionally arranged at a surface of the aluminum plate. The bamboo fibers have good breathability and high wear resistance, and have the functions of natural antibiosis, bacteriostasis, mite removal, deodorizing and ultraviolet ray resistance, and thus the effect of environmental protection is achieved.

DETAILED DESCRIPTION

The disclosure is further explained below in conjunction with the drawings.

Figure 1:
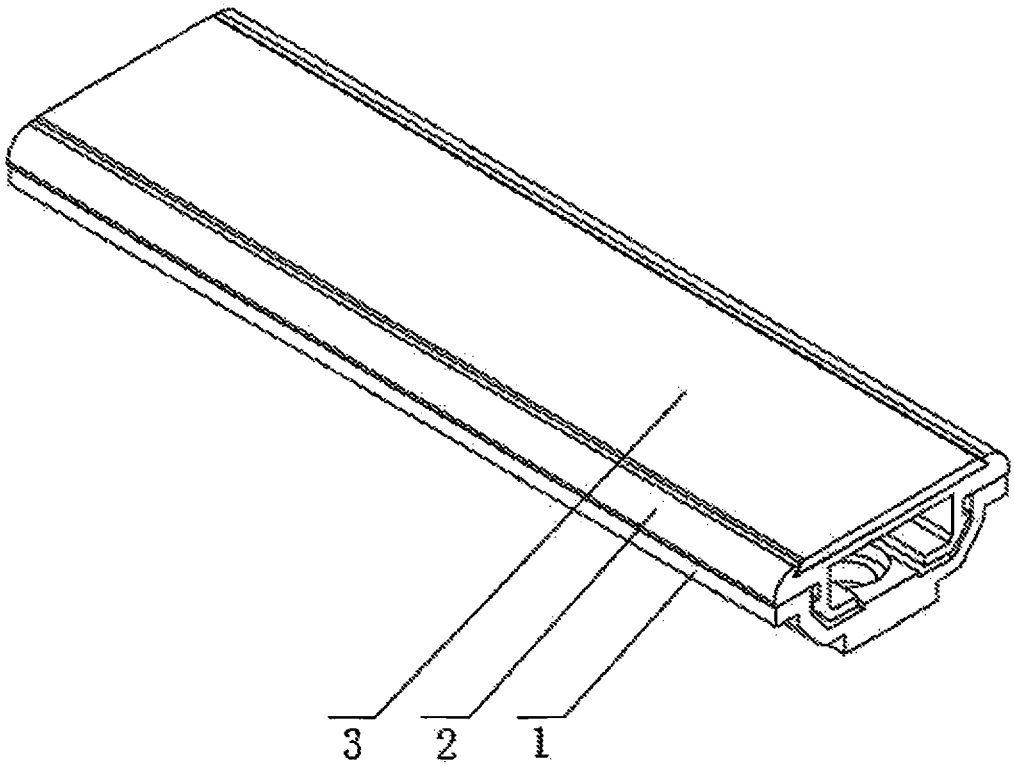
FIG. 1 is a stereoscopic structural diagram of a heat conducting mechanism according to the disclosure.
Figure 2:
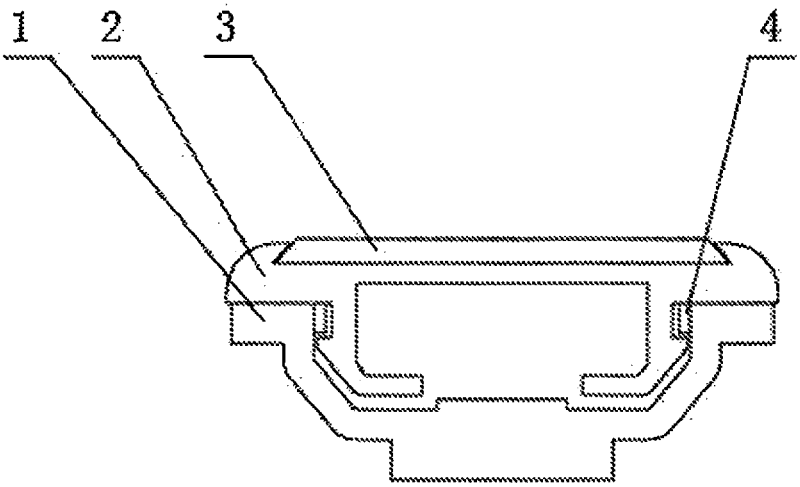
FIG. 2 is a front view of the heat conducting mechanism according to the disclosure.

Referred to FIGS. 1 and 2, the disclosure includes a heat conductor 2 and a mounting rack 1, wherein, the heat conductor 2 is fixedly mounted on the mounting rack 1, and wherein, the heat conductor 2 is an aluminum plate, and a bamboo fiber layer or a carbon fiber layer 3 is arranged at a working face of the heat conductor 2. The bamboo fiber layer or the carbon fiber layer 3 is laid at the working surface of the heat conductor 2, allowing a part in contact with hair in a working process to be the bamboo fiber layer or a carbon fiber layer 3.

The bamboo fiber layer or the carbon fiber layer 3 and the heat conductor 2 are independent respectively, and the bamboo fiber layer or the carbon fiber layer 3 is matched with the heat conductor 2 in an insertion way. Cone-shaped grooves are formed at the surface of the heat conductor 2, two sides of the bamboo fiber layer or the carbon fiber layer 3 are fitted with the cone-shaped grooves, and the bamboo fiber layer or the carbon fiber layer 3 is inserted into the cone-shaped grooves. The bamboo fiber layer or the carbon fiber layer 3 may also be fixed to the heat conductor 2 in a sticking way, only if it is ensured that the bamboo fiber layer or the carbon fiber layer 3 can not drop down.

Convex clamping blocks 4 are arranged on inner topper sides of a groove of the mounting rack 1, concave grooves fitted with the clamping blocks 4 are arranged at the outer surface of the heat conductor 2. The clamping blocks 4 are clamped in the concave grooves of the heat conductor 2, so that the heat conductor 2 is fixed in the mounting rack 1 and a phenomenon that the heat conductor 2 drops down is prevented from occurring.

A surface of the bamboo fiber layer or the carbon fiber layer 3 is higher than the surface of the heat conductor 2, and the bamboo fiber layer or the carbon fiber layer 3 has elasticity. Therefore, in a tightly holding process, in the case that the surface of the bamboo fiber layer or the carbon fiber layer 3 is higher than the surface of the heat conductor 2, the bamboo fiber layer or the carbon fiber layer 3 allows a position which is held tightly to be tighter and allows holding or perming of hair to be better in effect.

Bamboo fibers are of cellulosic fibers extracted from a bamboo growing naturally. The bamboo fibers have properties of good breathability, instant water absorption, stronger wear resistance and the like, and also have the functions of natural antibiosis, bacteriostasis, mite removal, deodorizing and ultraviolet ray resistance. Experts point out that the bamboo fibers are of natural environment-friendly green fibers in the real sense, and the bamboo fibers have highquality inverse elasticity, wear resistance, and flame resistance. The natural bamboo fibers can absorb water which is 20 percentage of weight of themselves, are highest in water absorption among other fiber fabric of the same density, and have excellent inverse elasticity and flame resistance.

The bamboo fibers and the aluminum plate are combined, that is, the advantages that the aluminum plate is easy to form, low in machining requirements and low in material cost are utilized. The bamboo fibers are used at the surface of the aluminum plate, also the advantages that the bamboo fibers have high strength, moderate elasticity modulus, good heat resistance, light weight, wear resistance and the like are utilized, and the heat conducting mechanism is allowed to be more resistant to heat and have no deformation.

Figure 3:
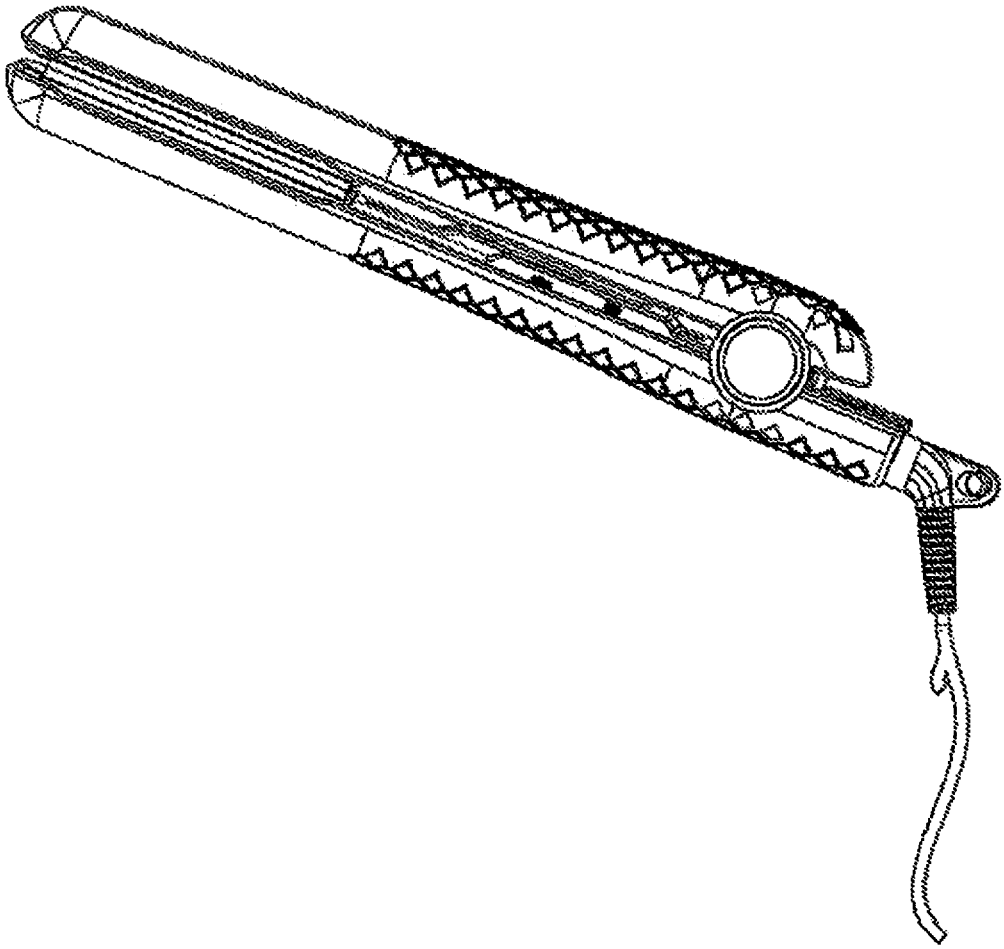
FIG. 3 is a stereoscopic diagram of a personal care device made by using the heat conducting mechanism.

Referred to FIG. 3, a personal care device using the heat conducting mechanism includes a pair of holding components, tails of which are hinged, wherein, the heat conducting mechanism is arranged inside the holding components, a heating body is embedded in the heat conducting mechanism, and the heat conducting mechanism is in contact with the heating body. Through using the heat conducting mechanism where the bamboo fiber layer or the carbon fiber layer 3 and the aluminum plate are combined, and through allowing the bamboo fiber layer or the carbon fiber layer 3 to be the working face, the defects that the aluminum plate has no heat resistance and no wear resistance in the past are solved.

The embodiments should not be regarded as limitation of the disclosure, and moreover any improvement made based on the spirit of the disclosure should be contained in the protection scope of the disclosure.

The invention claimed is:

1. A heat conducting mechanism for a personal care device, comprising:

a mounting rack;

a heat conductor fixedly mounted on the mounting rack, the heat conductor comprising an aluminum portion that includes a plate portion, a first side portion and a second side portion, the plate portion defining a working face, the first side portion positioned opposite the second side portion, each of the first side portion and the second side portion extending upwardly and away from the plate portion, the plate portion and the first and second side portions defining a fiber-layer receiving channel; and a fiber layer comprising a bamboo or a carbon fiber material that includes a bottom portion and a top portion above the bottom portion, the top portion defining a planar top surface that is generally parallel to the working face, the bottom portion of the fiber layer inserted into the fiber-layer receiving channel and arranged at a working face of the heat conductor so as to be in contact with the working face of the heat conductor, the top portion of the fiber layer positioned outside of the fiber-layer receiving channel and above the plate portion such that the entire planar top surface is above the heat conductor.

2. The heat conducting mechanism for the personal care device according to claim 1, wherein, the fiber layer and the heat conductor are independent components, and the bottom portion of the fiber layer defines a shape that is substantially the same as a shape defined by the fiber-layer receiving channel for insertion into the heat conductor.

3. The heat conducting mechanism for the personal care device according to claim 2, wherein the first side portion and an adjacent portion of the plate portion form a first groove defining a first acute angle, the second side portion and another adjacent portion of the plate portion form a second groove defining a second acute angle, and the fiber layer is inserted into the grooves.

4. The heat conducting mechanism for the personal care device according to claim 1, wherein convex clamping blocks are arranged on inner top sides of a groove of the mounting rack, and concave grooves fitted with the clamping blocks are arranged at an outer surface of the heat conductor.

5. A personal care device using the heat conducting mechanism according to claim 1, comprising: a pair of holding components, tails of which are hinged, wherein, the heat conducting mechanism is arranged inside the holding components, a heating body is embedded in the heat conducting mechanism, and the heat conducting mechanism is in contact with the heating body.

6. The heat conducting mechanism for the personal care device according to claim 1, wherein the fiber layer consists of a bamboo fiber layer.

7. The heat conducting mechanism for the personal care device according to claim 1, wherein the first side portion and an adjacent portion of the plate portion form a first groove defining a first acute angle, the second side portion and another adjacent portion of the plate portion form a second groove defining a second acute angle, the first groove and the second groove extend along a length of the heat conductor, and the fiber layer is inserted into the grooves.

8. The heat conducting mechanism for the personal care device according to claim 7, wherein the first acute angle is substantially the same as the second acute angle.

9. The heat conducting mechanism for the personal care device according to claim 8, wherein the first groove and the second groove are cone-shaped.

* * * * *